United States Patent [19]

Imes, Jr.

[11] 4,113,251

[45] Sep. 12, 1978

[54] TARGET GAME

[75] Inventor: Jack Imes, Jr., Chicago, Ill.

[73] Assignee: RB Toy Development Co., Skokie, Ill.

[21] Appl. No.: 753,171

[22] Filed: Dec. 22, 1976

[51] Int. Cl.[2] ..... A63B 71/02

[52] U.S. Cl. ..... 273/95 R; 273/102 R; 273/106 R; 273/DIG. 30

[58] Field of Search ..... 273/95 R, 102 R, 102 A, 273/102 B, 102 AF, 102 PM, 106 R, 106 B, 106 E, DIG. 30; 46/DIG. 1

[56] References Cited

U.S. PATENT DOCUMENTS

| | | | |
|---|---|---|---|
| 3,032,345 | 5/1962 | Lemelson | 273/95 R X |
| 3,391,933 | 7/1968 | Cooper | 46/DIG. 1 |
| 3,715,121 | 2/1973 | Renn et al. | 273/106 R X |
| 3,829,094 | 8/1974 | Goldfarb et al. | 273/95 R |
| 3,857,566 | 12/1974 | Lemelson et al. | 273/95 R |
| 3,917,271 | 11/1975 | Lemelson et al. | 273/106 R |
| 3,941,383 | 3/1976 | Clarke | 273/95 R |
| 3,980,303 | 9/1976 | Bolton | 273/95 R |

*Primary Examiner*—William H. Grieb

*Attorney, Agent, or Firm*—Vogel, Dithmar, Stotland, Stratman & Levy

[57] ABSTRACT

A target game wherein a missile having an end thereof provided with filamentary hook-like material of the type manufactured by the Velcro Corporation in conjunction with an open weave netting having openings in the range between of about ½ millimeter and 3 millimeters. Target representations each consisting of a solid member having indicia thereon, are positioned with the netting intermediate the representations and the missile thrower. When the missile having only the Velcro hooking elements thereon strikes the net, the net traps the missile to indicate the relative position of the missile and the target representations. The netting is such that it is easy to see the target representations therethrough.

11 Claims, 8 Drawing Figures

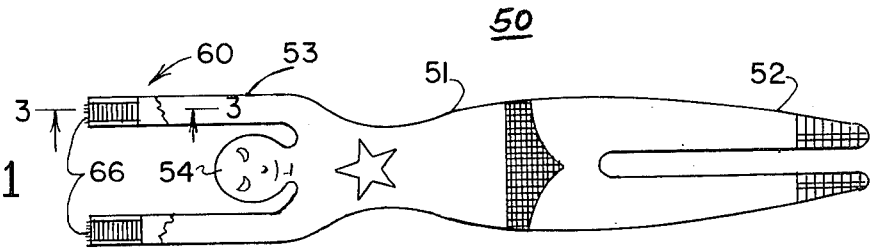
FIG. 1
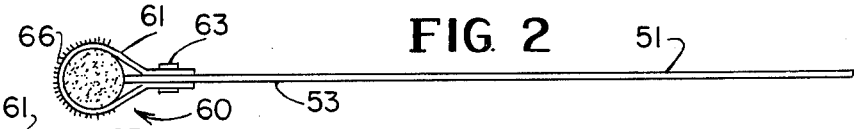
FIG. 2
FIG. 3
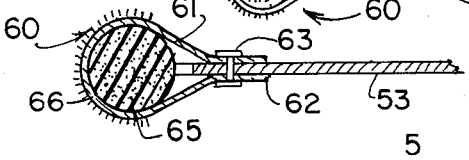
FIG. 5
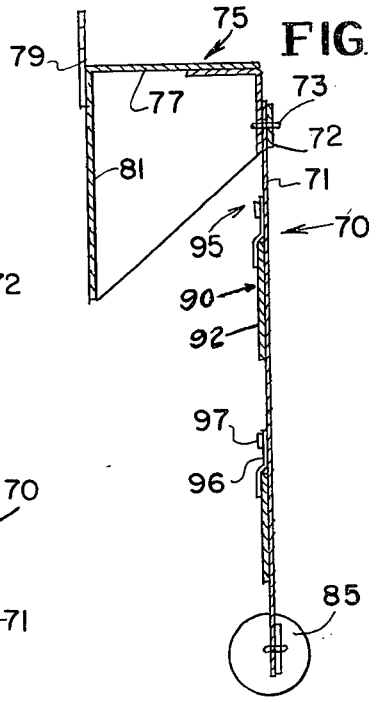
FIG. 4
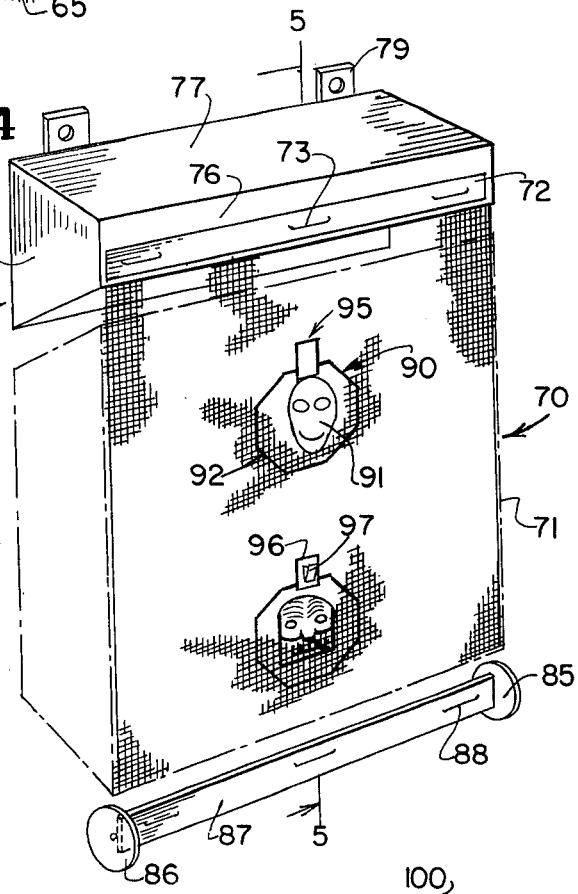
FIG. 7
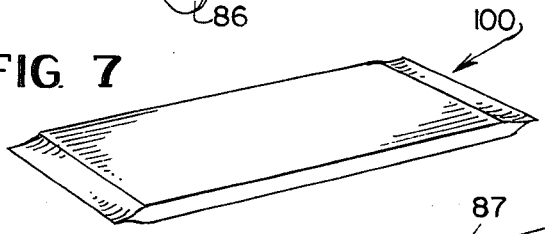
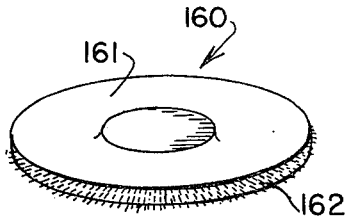
FIG. 8
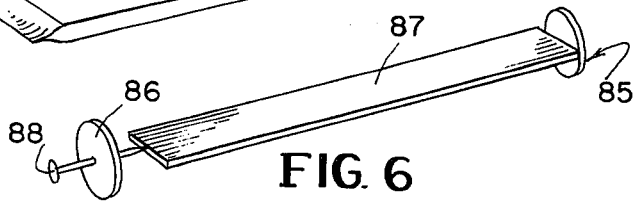
FIG. 6

TARGET GAME

BACKGROUND OF THE INVENTION

Target games are old, particularly those involving a missile and a target. With the advent of materials in which there is provided a loop portion and a hooking portion such as that produced by the Velcro Corporation, toys and games have been produced utilizing the hook (male portion) and loop (female portion) materials in various ways. Velcro or materials like Velcro have been used in target games, such as those described in U.S. Pat. Nos. 3,032,345, issued to Lemelson, May 1, 1962 and 3,857,566, issued to Lemelson, et al., Dec. 31, 1974 and 3,917,271, issued to Lemelson, et al., Nov. 4, 1975, but all of the games produced according to the teachings of these patents have several disadvantages. In the first place, Velcro or its alternative is expensive and large quantities of it render the game inapplicable for certain uses. Another disadvantage is, that Velcro when used for the target makes it extremely difficult to print indicia on the target. Velcro is opaque and cannot be seen through, whereby it is imperative that printing on the face of the Velcro be clear and distinct to provide an easy target for the missile thrower. As hereinbefore mentioned, Velcro is extremely difficult to print on and as a matter of fact, the characters or indicia on the Velcro are very indistinct and fuzzy.

These and other difficulties are obviated by the use of the present invention.

SUMMARY OF THE INVENTION

This invention relates to a new and improved structure in missiles and targets for games, and in particular, to structures in which only the male portion of Velcro material is used in conjunction with an open netting having a predetermined opening dimension, such that the Velcro material is trapped upon contact with the netting to retain the missile in place.

It is a general object of the present invention to provide a new target game in which the missile is provided with a filamentary hook formation on at least a portion thereof and the target includes an open weave net having openings sufficiently large to permit easy visability therethrough and small enough to entrap the filamentary hook material upon contact therewith.

Another object of the present invention is to provide a game comprising a missile having at least a portion of its surface defined by a multitude of filamentary hook formations, a target adapted to be secured adjacent an upstanding support such as vertical wall and composed of support means, and an open weave net connected to the support means having a plurality of openings therein, at least some of the openings having at least one dimension not greater than about 3 millimeters to engage the filamentary hook formations upon contact therewith, contact between the net and the hook formations causing engagement thereof sufficient to retain the missile in place to indicate the portion of the target struck thereby, the missile being removable from the target without tearing same.

These and other objects of the present invention may be more readily understood when taken in conjunction with the following specification and drawings, in which:

BRIEF DESCRIPTION OF THE DRAWINGS

FIG. 1 is a plan view of a missile in cartoon character form;

FIG. 2 is a side elevational view of the missile illustrated in FIG. 1;

FIG. 3 is an enlarged sectional view of the filamentary hook bearing portion of the missile shown in FIG. 2;

FIG. 4 is a perspective view of the target of the present invention secured to a support means;

FIG. 5 is a view in section of the target illustrated in FIG. 4 taken along line 5—5 thereof;

FIG. 6 is an enlarged elevational view of the spacing device of the bottom of the target illustrated in FIG. 4;

FIG. 7 is an illustration of a package carrying the missile and target materials illustrated in FIGS. 1 and 4; and FIG. 8 is a second embodiment of a missile for use with the target of the present invention.

DETAILED DESCRIPTION OF A PREFERRED EMBODIMENT

Referring now to the drawings, there is disclosed in FIGS. 1 to 3 thereof, a missile 50 in the form of a human-like character having a body torso portion 51 connected to legs 52 and outwardly stretched arms 53. A head 54 is connected appropriately to the torso portion 51. The missile engagement portion 60 is positioned in place of the characters hands and includes an arcuate holder 61 having attachment flanges 62 which are positioned on opposite sides of the arms 53. Attachment means such as a rivet or the like attach the flanges 62 to the arms 53. A shock absorber 65 of a flexible or resilient material, such as a sponge or the like, is intermediate the end of the arms 53 and the arcuate holder 61 to provide a cushion for the missile 50 when it strikes the target. Extending outwardly from the holder 61, is a filamentary hooking material 66 of the type commonly known as Velcro. The Velcro hooking material 66 is present on both arms 53 of the missile 50.

A target 70 includes an open weaved net 71 which may be constructed of any suitable synthetic organic resin and has openings therein of a critical size. The openings in the net 71 must be sufficiently large to permit good visability therethrough and sufficiently small to trap the hooking material 66 on the missile 50. It has been found, that net openings having a dimension substantially in excess of 3 millimeters are too large to trap and engage the filamentary hook materials, whereas netting having openings less than ½ millimeter in diameter is so opaque as to prevent good visability therethrough. For instance, nylon stockings of the type usually worn by women, have openings too small to act as a net for the present invention, since the hook material 66 will not engage the stockings. It is intended that whether the openings are square, that is diamond shaped, or hexagonal, it is the corner to corner measurement that determines the critical dimension of the net 71 for use in the present game. Nets 71 may have openings of various shapes, and may contain different shapes in the same net.

The target 70 with the net 71 includes an attachment means 72 in the form of a strip of suitable material such as cardboard or the like having attachment fasteners 73 thereon, the fasteners may be staples or other suitable mechanism. The attachment means 72 is connected by fasteners 73 to a support 75, which support may be the top of a cereal box if the game is included as a premium in a package of cereal. It is understood, that the support 75 need not be a cereal box, but may consist of any support sufficient to hang the target 70 from a vertical support and spaced therefrom a distance sufficient such that the missile 50 inpinging upon the target 70 does not strike a solid surface and bounce off. The support 75 includes a front wall 76 receiving the attachment means 72 thereon, a top wall 77, spaced apart side walls 78 and a back wall 81 having a holder 79 extending therefrom. The holder 79 may consist of any suitable attachment mechanism for attaching the support 75 to an upstanding wall or TV tube or the like.

A spacer mechanism 85 is connected to the bottom of the target 70 and in particular to the bottom of the net 71. The spacer mechanism 85 includes spaced apart circular members or disks 86 interconnected by a strip 87 of the same type as the attachment means 72. Suitable attachment means 88 connect the strip 87 to the netting 71. The spacer mechanism 85 including the disks 86 provide a weight at the bottom of the target 70 sufficient to provide tension to the target 70 and particularly the net 71 to maintain the net substantially wrinkle free. The spacer mechanism 85 and in particular the disks 86 may be made of any suitable material sufficiently heavy to provide the required tension.

Target representations 90 may be supplied with the target 70 and the missile 50 to complete the game. Each representation 90 includes a body portion 92 having indicia 91 thereon for illustration, the indicia may be in the form of a human-like or fantasy creature, but it is understood that the indicia 91 may take any form desirable. The target representations 90 are connected to the side of the netting 71 away from the missile thrower as illustrated in FIG. 5, and to that end, fastening means 95 is provided with each target representation 90. Each of the fastening means preferably includes a strip 96 of female or loop Velcro material and a strip 97 of male hooking formations of Velcro material. The male strip 97 is connected to the female strip 96 through the net 71, thereby to secure the target representation 90 behind the netting 71 and away from the missile thrower. When the missile 50 is launched and strikes the netting 71, the weave thereof traps the hooking material 66 and retains the missile in place on the target 70 with respect to the target representation 90, thereby to permit scoring of any type desirable.

The package 100 shows the facility with which the misile 50 and target 70 along with the representations 90 may be compactly packaged for insertion into a box of cereal as a premium.

Referring now to FIG. 8, there is disclosed a second embodiment of a missile 160 for the present invention, in which the missile is a disk with a body portion and a peripheral flange 161. The peripheral flange 161 carries on at least a portion thereof suitable filamentary hook material 162 of the same type previously disclosed for use with the missile 50. Throwing of the disk 160 in a manner to engage the netting 71 will cause engagement of the hooking material by the netting 71 and retention of the missile 160 in place on the target 70.

It is intended that both missiles 50 and 160 need not have the hooking material 66 over a large portion of the missile body. For instance, in using the missile 160, spacing the hooking material 162 intermittently around the periphery of the disk 168 would require more skill to perform the game and therefore, it is contemplated that only portions of the peripheral edge of the disk 160 will have the hooking elements 162 thereon. Similarly, the missile 50 carries filamentary hooking material 66 on only a small portion of the missile. The missile 50 while in the form of a human-like or cartoon character may be of any form desired and may be of any suitable material whether it be cardboard or plastic.

Various nets have been tested, and it has been found that the thickness of the net material also determines the effectiveness of the retention thereby of the hooking material 66 or 162. If the net is greater than about ½ mm. in thickness, the hooking material has a tendency to bounce off, rather than adhere, whereby it is necessary that the net is less than one-half millimeter in thickness.

While there has been described what at the present time is considered to be the preferred embodiment of the present invention, it will be understood that various modifications and alterations may be made therein without departing from the true spirit and scope of the present invention. It is intended to cover in the appended claims all such variations and modifications which do not depart from the true concept of the present invention which is the provision of a missile having small portions of filamentary hooking formations thereon for use in conjunction with an open weave netting wherein the apertures are between 3 millimeters and ½ millimeter in size from corner to corner.

What is claimed is:

1. A game comprising a missile having at least a portion of its surface defined by a multitude of filamentary hook formations, a target adapted to be secured adjacent an upstanding support such as a vertical wall and composed of support means, and an open weave net having a thickness not greater than about ½ millimeter connected to said support means and having a plurality of openings therein, at least some of said openings having at least one dimension not greater than about three millimeters and all of said openings having a dimension not less than about ½ millimeters to engage said filamentary hook formations upon contact therewith, at least one target representation and means for positioning said target representation on the side of the net away from the thrower, said target representation being visible through said net, contact between said net and said hook formations causing engagement thereof sufficient to retain said missile in place to indicate the portion of said target struck thereby, said missile being removable from said target without tearing of same.

2. The game of claim 1, wherein said missile is an elongated member having said hook formations on an end thereof.

3. The game of claim 1, wherein said missile is in the form of a human-like character with arms and hands extended carrying said filamentary hook formations.

4. The game of claim 1, wherein said missile includes a solid portion and a resilient portion intermediate said solid portion and said hook formations.

5. The game of claim 1, wherein said missile is disc shaped having said hook formations on the peripheral edge thereof.

6. The game of claim 1, wherein at least some of said openings have a dimension of about 1 millimeter.

7. The game of claim 1, and further comprising a weight on the bottom of said target to provide tension thereto.

8. The game of claim 1, and further providing a spacer mechanism near the bottom of said target mounted thereon to maintain said target a predetermined distance from the support and to limit swinging movement between said target and the support.

9. A game comprising a missile having at least a portion of its surface defined by a multitude of filamentary hook formations, a target adapted to be secured adjacent an upstanding support such as a vertical wall and composed of support means, and an open weave net connected to said support means and having a plurality of openings therein, at least some of said openings having at least one dimension not greater than about three millimeters to engage said filamentary hook formations upon contact therewith, at least one target representation having attachment means thereon for fixed placement thereof with respect to said net on the side thereof away from the missile thrower, said representation being visable through said net, and said net having an exposed portion thereof in registry with said representation for engaging said hook formations on said missile, contact between said net and said hook formations causing engagement thereof sufficient to retain said missile in place to indicate the portion of said target struck thereby, said missile being removable from said target without tearing of same.

10. The game of claim 9, wherein said attachment means on said representation includes a plurality of filamentary hook formations.

11. The game of claim 9, wherein said attachment means on said representation includes a plurality of filamentary loop formations on said representation and a mating member of filamentary hook formations, which extending through said net engaging said loop formations mount said representation on said net.

* * * * *